United States Patent [19]

Nishikawa

[11] Patent Number: 5,016,036

[45] Date of Patent: May 14, 1991

[54] DEVICE FOR DEVELOPING RECORDING MEDIA WITH LIQUID DEVELOPER

[75] Inventor: Masaji Nishikawa, Hachioji, Japan

[73] Assignee: Olympus Optical Co., Ltd., Tokyo, Japan

[21] Appl. No.: 538,929

[22] Filed: Jun. 15, 1990

[30] Foreign Application Priority Data

| | | | |
|---|---|---|---|
| Jun. 21, 1989 | [JP] | Japan | 1-158799 |
| Jun. 21, 1989 | [JP] | Japan | 1-158800 |
| May 8, 1990 | [JP] | Japan | 2-118211 |

[51] Int. Cl.[5] ..... G03D 5/06; G03D 5/00

[52] U.S. Cl. ..... 354/318; 354/317; 354/324

[58] Field of Search ..... 354/317, 324, 318; 355/256

[56] References Cited

U.S. PATENT DOCUMENTS

| | | | |
|---|---|---|---|
| 4,623,236 | 11/1986 | Stella | 354/317 X |
| 4,634,252 | 1/1987 | Jeremijevic | 354/324 |
| 4,947,199 | 8/1990 | Tsunekawa | 354/324 |

*Primary Examiner*—A. A. Mathews

*Attorney, Agent, or Firm*—Frishauf, Holtz, Goodman & Woodward

[57] ABSTRACT

A developing device of such liquid developer circulating type that introduces the liquid developer into a developing head by the action of negative pressure suction force created by a suction pump to develop a latent image on a recording medium by the liquid developer thus introduced, characterized by a means for adjusting and controlling the pumping capacity of the suction pump, responsive to a control command which represents a predetermined sequence and condition of the liquid developer circulated. It is preferable to add to the device a means for adjusting and controlling the pumping capacity of the suction pump, responsive to a control command obtained relating to a surface roughness of the recording medium, a means including a timer circuit for controlling the suction pump to operate with high pumping capacity for a predetermined time period after the operation of the pump is started, and then with low pumping capacity, and a means for adjusting and controlling the pumping capacity of the suction pump, responsive to a detection signal sent from a sensor which serves to detect a condition of the liquid developer flowing through the developing head.

8 Claims, 5 Drawing Sheets

DEVICE FOR DEVELOPING RECORDING MEDIA WITH LIQUID DEVELOPER

BACKGROUND OF THE INVENTION

1. Field of the Invention

The present invention relates to a developing device of the liquid developer circulating type which includes a developing head provide with a rod-like body and at least one liquid developer flowing passage having a slit-shaped opening on the top of the rod-like body, wherein a latent image formed on a recording medium such as an electrostatic recording paper which is fed on the slit-shaped opening, can be developed into a visible image by a liquid developer flowing through the passage.

More particularly, it relates to a developing device of the liquid developer circulating type wherein a liquid developer in a tank is introduced into a developing head by the action of negative pressure created by a suction pump to develop a latent image on a recording medium, and then returned into the tank after this development of the latent image is finished.

2. Description of the Related Art

The developing device of the liquid developer circulating type intended to use negative pressure suction force created by the suction pump is conventionally well known. The developing device of this type includes a developing head provided with liquid developer flowing passages each having a slit-shaped opening on the top of a rod-like body to allow liquid developer to act on a latent image on a recording medium, a tank for storing the liquid developer supplied to the developing head, a suction pump for introducing the liquid developer in the tank into the liquid developer flowing passages, which are provided with the slit-shaped openings, by suction force created by negative pressure, and a piping for connecting these three components to one another.

The operation of the developing device is as follows. The slit-shaped openings of the liquid developer flowing passages in the developing head are covered by the recording medium itself and the suction pump is made operative while moving the recording medium relative to the developing head. The whole of that part of the liquid developer circulating line which is located on the upstream side of the suction pump and which includes the liquid developer flowing passages are thus made negative in pressure and the liquid developer in the tank is sucked into the developing head by suction force created by this negative pressure in the part of the liquid developer circulating line. The liquid developer thus sucked flows through the liquid developer flowing passages having the slit-shaped openings to thereby develop the latent image on the recording medium by the liquid developer. After this development of the latent image, the liquid developer is returned into the tank.

In the case of this developing device of the liquid developer type having the above-described arrangement, a predetermined negative pressure must be held in the liquid developer circulating line extending from the tank to the suction pump at least at the time of development. It is therefore needed that the slit-shaped openings of the liquid developer flowing passages in the developing head are air-tightly covered by the recording medium. When the recording medium is wrinkled and slackened to damage its air-tight covering relative to the slit-shaped openings of the passages and when air is leaked through the piping, the liquid developer cannot be circulated through the line to develop the latent image on the recording medium as desired. Further, when such a recording medium that is high in surface roughness is used, same demerit is caused In order to eliminate this demerit, a device provided with a means for detecting any abnormal level of negative pressure to sound alarm was proposed. The Japanese Utility Model Publication Sho 52-25153, for example, disclosed a means for detecting any abnormal level of negative pressure by a negative pressure sensor. According to this means, the level of negative pressure is detected by the negative pressure sensor, it is asked whether the value thus detected is larger or smaller than a reference value previously set, and alarm is sounded or displayed depending upon the result thus obtained.

In the case of the developing device of the liquid developer circulating type intended to use suction force created by negative pressure as described above, the pumping capacity of the suction pump is fixed to a certain level. When the recording media are not uniformly stuck relative to the top of the developing head, therefore, the suction force created by negative pressure changes accordingly. Particularly when they are wrinkled and slackened, stable circulation of the liquid developer is damaged not to apply excellent development relative to the latent images on them. Further, in the case of the conventional developing device in which the pumping capacity of the suction pump is fixed to a certain level, a relatively long time is needed until the liquid developer can start its stable circulation through the liquid developer circulating line after the start of the suction pump. It is therefore after the time needed to rise the suction pump lapses that the developing process can be started. This asks a long time before the developing process is practically started. Still further, the suction pump is started while carrying the recording medium to more reliably stick the recording medium onto the developing head in the case of the conventional developing device. As the result, large quantity recording medium is wasted.

It is imagined that the pumping capacity of the suction pump is made high enough to eliminate the above-mentioned drawbacks. When this is realized, the recording medium can be reliably stuck onto the developing head and the time needed before the developing process is practically started can be shortened. In addition, the large quantity recording medium which are wasted can be reduced.

However, the running load of the recording medium is increased because the suction force by which the recording medium is stuck onto the developing head is made large. Force for feeding the recording medium is needed to become large. This causes the medium carrying motor and the drive circuit to be made large in size and capacity.

Further, the surface unevenness of the recording medium is crushed and deformed because the image-formed surface of the recording medium is strongly pressed against the top of the developing head. This causes the surface roughness of the recording medium to be changed and the fine amount of air leaked through the developing head is changed accordingly. As the result, the running load of the recording medium is further increased and the developing characteristics of the device are changed accordingly. Still further, in the case where the device in which the above-mentioned developing means is incorporated is intended to record an color image on the recording medium by overlapping plural colors one upon the others, undesirable influences are added to developing and recording characteristics of the device. Namely, it becomes difficult to hold correct the recording characteristics which depend upon the surface roughness of the recording medium. As the result, the quality of images recorded is deteriorated. Still further, it sometimes happens that pieces of dust stick to the surface of the recording medium and that these pieces of dust are press-extended. This causes images recorded on the surface of the recording medium to seem humble.

The common paper, synthetic paper or transparent plastic film is used as the base sheet of those recording media which are used by the above-mentioned multicolored images recording device. When the base sheet for a recording medium is different from the one for another recording medium, the manners of processing recording layers coated on the image-recorded surface of these two recording media are different from each other. If these manners of processing the recording layers are different, the surface roughness of one of the recording media becomes different from that of the other.

The recording media which are different in surface roughness from the other cause the amount of air leaked through the gap between the slit-shaped openings of the liquid developer flowing passages on the developing head and the recording media to be changed. Even when the recording media are neither wrinkled nor slackened, therefore, the level of negative pressure in the liquid developer circulating line and the amount of the liquid developer circulated therethrough change depending upon different surface roughnesses of the recording media. When the amount of the liquid developer circulated changes, the developing capacity of the device becomes different to thereby form images short in density or cause base fog because of excessive development.

SUMMARY OF THE INVENTION

An object of the present invention is therefore to provide a developing device of the liquid developer type capable of reliably sticking recording medium relative to a developing head to enhance the reliability of the device even if recording medium is wrinkled or slackened; shortening the time needed until the developing process is practically conducted after the device is started; reducing the number of recording medium which is wasted; and achieving these merits without making the device large in size and deteriorating the recording characteristics of the device.

Another object of the present invention is to provide a developing device of the liquid developer type capable of preventing the difference in the surface roughness of the recording media from lowering the developing capacity of the device, from increasing the running load of the recording media and from deteriorating the recording characteristics of the device; and capable of bringing the device under stable operation without depending upon the difference in the surface roughness of the recording media.

The following fundamental measures are to be employed by the present invention in order to achieve these objects:

In a developing device of the liquid developer circulating type including a developing head, a tank for storing liquid developer, a suction pump and a piping for connecting these three components to one another (1) a means is used to adjust and control the pumping capacity of the suction pump, responsive to a control command which represents a predetermined sequence and/or a condition of the liquid developer circulated, (2) a control command which represents a surface roughness of the recording media is obtained and the pumping capacity of the suction pump is adjusted and controlled responsive to this control command obtained (3) a means provided with a timer circuit serves to control the suction pump to operate with high pumping capacity for a predetermined time period after the developing device is started, and then with low pumping capacity, and (4) a state of the liquid developer flowing through the developing head is detected by a negative pressure or instantaneous flow rate sensor, and the pumping capacity of the suction pump is adjusted and controlled responsive to a detection signal applied from the sensor.

These measures employed can provide the following merits:

When the measure cited at the item (1) is employed, the amount of the liquid developer circulated can quickly reach its correct level and be stably held at this level. As the result, excellent development can be attained without deteriorating the recording medium and increasing the running load of the recording medium.

When the measure cited at the item (2) is employed, the suction pump can be operated with such a pumping capacity as corresponds to a surface roughness of the recording media. The flow rate of the liquid developer needed to develop images on the recording media can be thus guaranteed together with the correct level of negative pressure. This can prevent too high negative pressure from causing surfaces of the recording media to be crushed by the developing head and changed in surface roughness and increasing the running load of the recording media.

When the measure cited at the item (3) is employed, the suction pump can be operated with high pumping capacity for a predetermined time period just after the developing device is started. The recording medium can be thus quickly and reliably stuck onto the slit-shaped opening of the liquid developer flowing passage on the developing head. The liquid developer can be quickly introduced into the developing head to thereby shorten the time needed to prepare the development of images on the recording medium. The recording medium can be stuck onto the developing head while being kept stationary, thereby reducing the number of recording medium which is wasted.

When the measure cited at the item (4) is employed, the condition of the liquid developer flowing through the passages on the developing head can be observed at all times by the sensor. The pumping capacity of the suction pump can be thus automatically set at a correct level so as to meet any differences in the surface roughness of the recording media. This can prevent air from being abnormally leaked because of wrinkles and the like of the recording media caused in the course of the developing process. The number of those recording media which are wasted by this leakage of air can be reduced accordingly.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 and 2 show a first embodiment of the present invention, in which FIG. 1 shows an arrangement of the device and FIG. 2 is intended to explain what merits the device can achieve;

FIGS. 3 and 4 show a second embodiment of the present invention, in which FIG. 3 shows another arrangement of the device and FIG. 4 is a timing chart showing the device can be operated at;

FIGS. 5 and 6 show a third embodiment of the present invention, in which FIG. 5 shows a further arrangement of the device and FIG. 6 is a timing chart showing the device can be operated at;

FIGS. 7 and 8 show a fourth embodiment of the present invention, in which FIG. 7 shows a still further arrangement of the device and FIG. 8 is a timing chart showing the device can be operated at; and FIGS. 9 and 10 show a fifth embodiment of the present invention, in which FIG. 9 shows a still further arrangement of the device and FIG. 10 is a sectional view showing the center portion of a developing head shown in FIG. 9.

DETAILED DESCRIPTION OF THE PREFERRED EMBODIMENTS

(First Embodiment)

Figure 1:
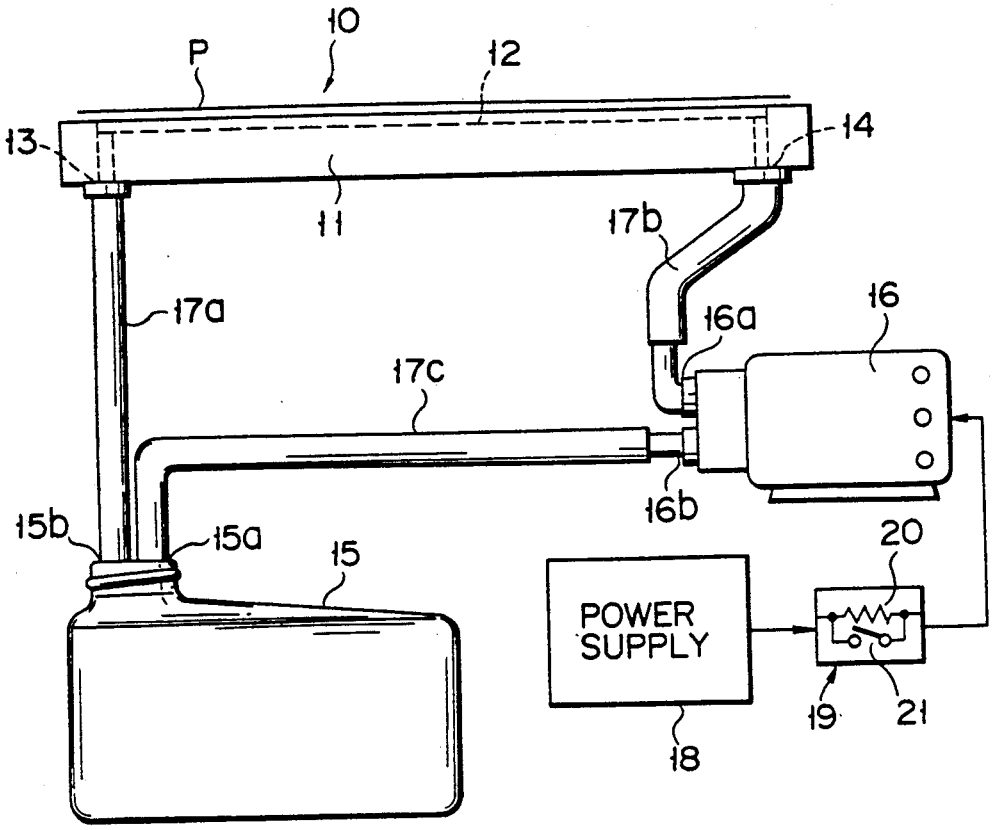

FIG. 1 is a front view showing a first embodiment of the developing device according to the present invention.

In FIG. 1, reference numeral 10 represents a developing head, 11 a rod-like body, 12 a slit-shaped developing groove having a slit-shaped opening, 13 an inlet through which liquid developer is supplied, 14 an outlet through which the liquid developer is discharged, 15 a tank in which the liquid developer is stored, 16 a suction pump, 17*a*–17*c* pipes arranged, 18 a power supply, 19 a measures for controlling the suction pump, 20 a resistance, 21 a short-circuit switch and P a recording medium.

The developing head 10 includes the rod-like body 11 made of metal such as aluminum or stainless steel, for example, and the slit-shaped developing groove having the slit-shaped opening and formed in the top of the rod-like body to allow the liquid developer to act on a latent image on the recording medium P. The inlet 13 and the outlet 14 provided in the lower portion of the rod-like body 11. The inlet 13 and outlet 14 are communicated respectively with both ends of the developing groove 12 and through which the liquid developer is supplied and discharged.

The tank 15 stores the liquid developer therein to supply it to the developing head 10.

The suction pump 16 creates negative pressure on the side of its suction opening 16*a* by its pumping action to such the liquid developer in the tank 15 into the slit-shaped developing groove 12 of the developing head 10 by the action of the negative pressure suction force thus created.

The pipe 17*a* connects an outlet 15*a* of the tank 15 to the inlet 13 of the developing head 10. The pipe 17*b* connects the outlet 14 of the developing head 10 to an inlet 16*a* of the suction pump 16. The pipe 17*c* connects an outlet 16*b* of the suction pump 16 to an inlet 15*a* of the tank 15.

The power supply 18 serves to supply electric energy to the suction pump 16 and drive it.

The measures 19 adjusts and controls the pumping capacity of the suction pump 16 responsive to a command which corresponds to a predetermined sequence and/or a condition under which the liquid developer is circulated. The control measures 19 includes the resistance 20 and the short-circuit switch 21 connected parallel to each other so as to prevent the amount of the liquid developer circulated and the negative pressure in the suction pump from becoming unsuitable for roughnesses of the surface of the recording medium P. Namely, the short-circuit switch is switched on and off to charge voltage supplied to the suction pump 16 so as to adjust and control the pumping capacity of the suction pump 16.

The recording medium P having a width larger than the length of the developing groove 12 is placed on the developing head 10 with its latent image-formed face directed downward to cover the slit-shaped opening of the developing groove 12. When the suction pump 16 is made operative under this state, air is discharged through the pipe 17*b*, developer outlet 14 of the developing head 10, developing groove 12, developer inlet 13 and pipe 17*a* to thereby make them negative in pressure. This enables the developer to be sucked from the developer tank 15 into the developing head 10 through the pipe 17*a*. The developer thus sucked flows to the suction pump 16 through the developing groove 12 and pipe 17*b*, and it is then circulated from the pump 16 to the developer tank 15 through the pipe 17*c*. The electrostatic latent image on the recording medium P is thus developed.

In the case of this first embodiment of the developing device according to the present invention, the short-circuit switch 21 of the pump capacity control measures 19 is switched on and off to adjust and control the pumping capacity of the suction pump 16, so that the flow rate of the developer and the negative pressure in the developer circulating line of the developing device can be prevented from becoming inappropriate to the surface roughness of the recording medium P.

In a case where the surface of the recording medium P used is high in the level of roughness, for example, the switch 21 is closed. High voltage is thus applied to the suction pump 16, which is driven at high speed to achieve high pumping capacity.

In another case where the surface of the recording medium P used is low in the level of roughness, for example, the switch 21 is opened. In this case, comparatively low voltage which has been dropped in voltage by the resistance 20 is thus applied to the suction pump 16, which is therefore driven at low speed to attain low pumping capacity.

When the short-circuit switch 21 is switched on and off in this manner to respond to surface roughnesses of the recording media P, the negative pressure in the liquid developer circulating line, the flow rate of the developer and the running load of the recording media P can be controlled to respond to the surface roughnesses of the recording media P.

Figure 2:
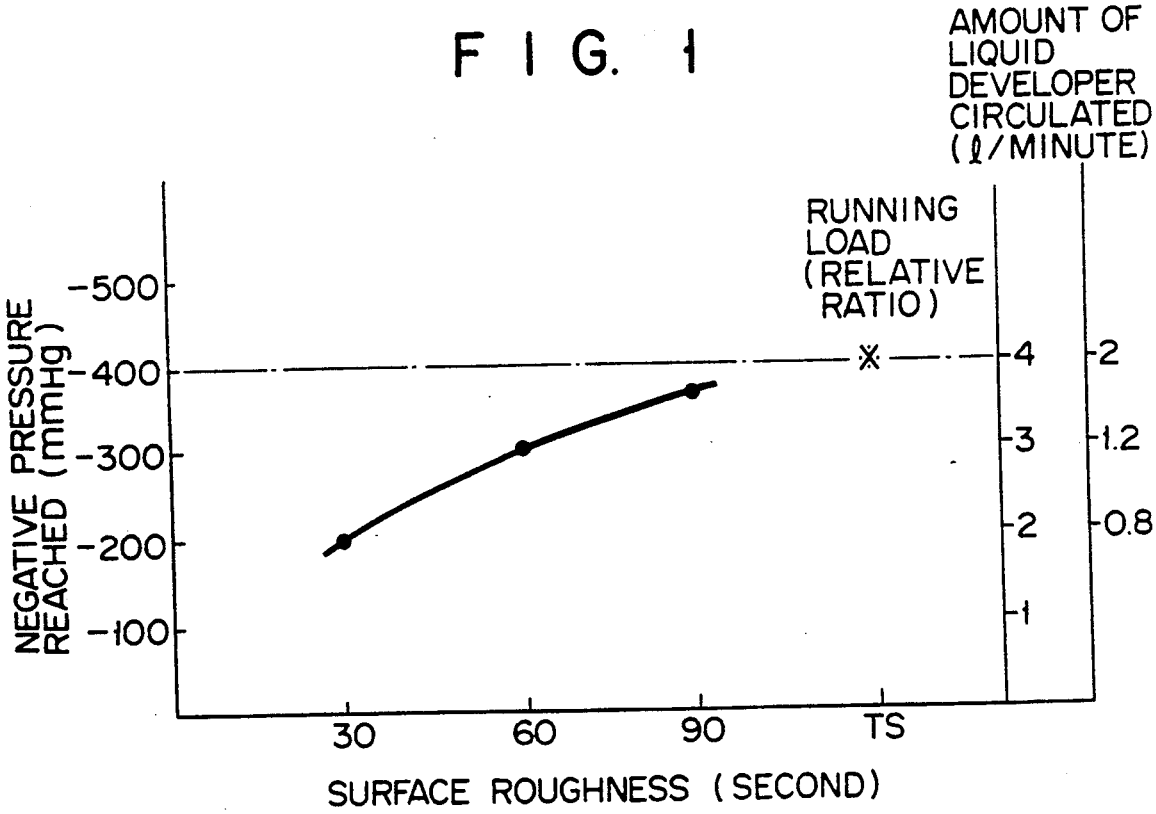

FIG. 2 is a graph showing data practically measured, in which surface roughnesses of the recording media P are plotted on the horizontal axis, while negative pressures (mmHg) obtained in the liquid developer circulating line, flow rates (liters/minutes) of the developer circulated and running loads (relative ratio) of the the recording media P are plotted on the vertical axis.

The developing head 10 practically used has six developing grooves 12 each having the slit-shaped opening and formed parallel to one another on the top of the rod-like body 11. Each of the liquid developing grooves 12 has such a length that enables effective development of 35-inch width to be applied to the recording medium P, 36 inches wide, and it also has a sectional area of 2 mm×2 mm.

The recording media P practically used had surface roughnesses which were in a range of 30–90 (seconds). The surface roughnesses of these samples were measured by the Beck tester which was defined by JISP8119. TS on the horizontal axis in FIG. 2 denotes a sample whose surface is extremely low in the level of roughness. It was however practically difficult to obtain this sample whose surface roughness is so low. Instead of this sample which had such a surface roughness as to closely adhere to the top of the developing head 10, an adhesive tape was used and the top of the developing head 10 was completely sealed by this adhesive tape. TS represents a condition under which the top of the developing head 10 is completely sealed by the adhesive tape.

A mount of the liquid developer circulated represent values obtained by accumulating only for a minute those of the developer flowing through the liquid developer circulating line.

Running loads of the recording medium P denote those of it on the developing head 10 measured when it is moved at a speed of about 1 (inch/second), using the above-mentioned developing head 10 and under the condition that the developer is stably circulated through the liquid developer circulating line. This measurement was intended to read forces needed from a spring balance while moving the recording media by pulling a bar attached to the recording media by the spring balance and the values shown denote relative ratios of values measured. Needless to say, the measurement of these running loads was conducted relative to the recording media P which were different in surface roughness, but except the case where the top of the developing head 10 was completely sealed by the adhesive tape.

As shown in FIG. 2, the negative pressure reached obtained changes from −200 to 370 mmHg as the surface roughness of the recording media P changes from 30 to 90 seconds. It is therefore found that as the seconds becomes larger or unevenness on the surface of the recording media P becomes smaller, the negative pressure becomes higher.

The negative pressure suction force created by the suction pump influences the flow rate of the liquid developer circulated. As the surface roughness of the recording media P changes from 30 to 90 seconds, the flow rate of the liquid developer circulated changes about two times. When the pumping capacity of the pump is kept certain, therefore, the density of image developed changes to a great extent as the surface roughness of the recording media P changes.

The running load of the media P also changes two times or less as the surface roughness of the media P changes from 30 to 90 seconds. When the pumping capacity of the pump is fixed certain in the conventional case, therefore, the power of a motor (not shown) for feeding the recording media must be set large. When the running load is large, the recording media P is strongly pushed against the top of the developing head 10. The unevenness on the surface of the recording media P is thus reduced and the surface of the media P is made smooth every time when the development is repeated. This causes the running load of the media P to be increased. Further, when the surface of the recording media P becomes smooth, the gap between the recording media P and the recording head (not shown) changes to thereby influence recording characteristics. Particularly when recording is conducted by the multi-stylus electrostatic recording head or color images are formed by the recording head of such type that its recording characteristics are delicately influenced by the discharge gap, its excellent recording characteristics cannot be kept because the changing gap.

As apparent from FIG. 2, the negative pressure reached, the flow rate of the liquid developer circulated and the running load of the recording media P change to a great extent, depending upon the surface roughnesses of the media P. Therefore, they can easily detected. In addition, the pumping capacity of the pump can be adjusted and controlled responsive to their information detected and effects thus achieved are large.

The first embodiment of the developing device shown in FIG. 1 as such an arrangement that can meet the above-mentioned requites.

The control measures 19 shown in FIG. 1 serves to control voltage supplied to the suction pump 16. However, the pumping capacity of the pump 16 may be controlled other control measures It may be controlled in such a way that a throttle valve is arranged in the pipe 17*b* or 17*c* located on the inlet or outlet side of the pump 16 and that resistance against the developer flowing through the pipe is appropriately changed by the throttle valve. Or it may be controlled in such a way that a lead valve is located between the developer outlet 14 of the developing head 10 and the suction pump 16 and that the amount of air leaked is changed by the lead valve. Or it may be controlled in such a way that a mechanical speed changing measures is arranged in the pump driving system and that the measures is adjusted.

The switch 21 shown in FIG. 1 is manually switched on and off responsive to the information previously obtained relating to the surface roughness of the recording media P so as to control command the pumping capacity of the pump 16. However, it may be arranged that kinds of the recording media P are automatically detected by a optical transmittivity measuring means or the like and that a semiconductor switch or the like is automatically controlled on and off responsive to the information thus detected. Or it may be arranged that the level of negative pressure in the developer circulating line is detected as seen in other embodiment of the developing device which will be described later, and that a control command is generated responsive to the information thus detected.

The developing head 10 shown in FIG. 1 includes the rod-like body 11 and the developing groove 12 of small sectional area having the slit-shaped opening formed on the top of the body 11. As shown in other embodiment of the developing device which will be described later, however, a developing head of the roller type in which a liquid chamber having slit-shaped opening is formed in the rod-like body and a developing roller is housed in the liquid chamber may be employed. Same effects as those achieved by the control measures 19 can be attained in this case.

(Second Embodiment)

Figure 3:
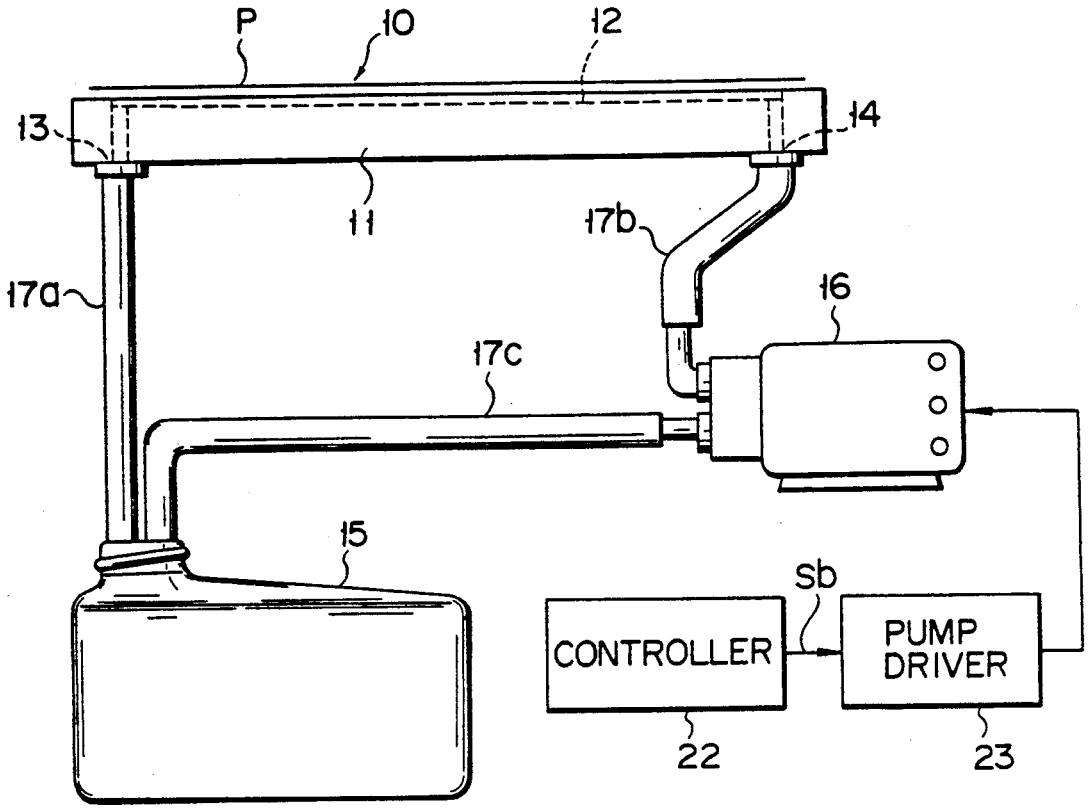

FIG. 3 shows a second embodiment of the developing device according to the present invention. In FIG. 3, reference numeral 22 denotes a controller including a timer circuit, and 23 a pump driver capable of switching the pumping capacity of the pump into high and low levels. Other components of the developing device shown in FIG. 3 are same as those in the first embodiment of the developing device shown in FIG. 1.

The controller 22 includes the timer circuit intended to control the suction pump 16 in such a way that the pump 16 can be operated with high pumping capacity for a certain time period just after the developing device is started and that it can be then operated with low pumping capacity.

The recording medium P is placed on the developing head 10, with its latent-image-formed face directed downward, so as to cover the developing groove 12 on the top of the developing head 10 and the suction pump 16 is then made operative. The suction pump 16 is controlled by the pump driver 23, which responds to a control command applied from the controller 22 as will be later described in detail, to operate with high pumping capacity for a certain time period just after the developing device is started. When the pumping capacity of the suction pump 16 is increased, amount and speed of air sucked through the developing groove 12 become large. The recording medium P is therefore quickly and surely pulled onto the slit-shaped openings of the developing groove 12 on the top of the developing head 10. The recording medium P is thus closely contacted with the top of the developing head 10 on which the developing groove 12 is formed. The developing groove 12 on the top of the developing head 10 is sealed by the recording medium P and high negative pressure is created therein. This high negative pressure sucks the developer in the tank 15 into the developing head 10 through the pipe 17*a* and the developer thus introduced fills the developing groove 12 and flows therethrough. The developing head 10 is thus made ready for developing the latent image on the recording medium P.

Figure 4:
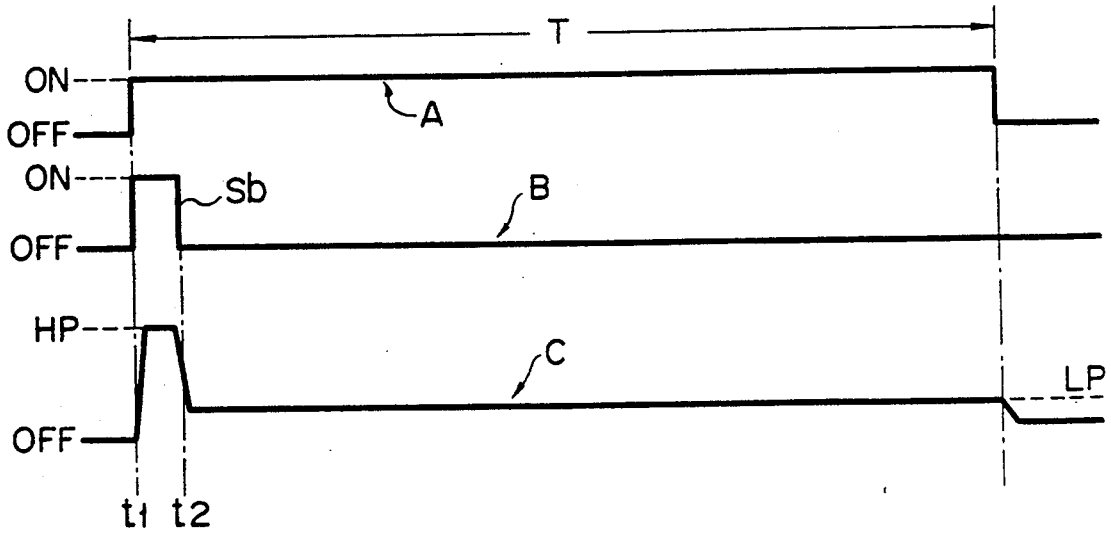

FIG. 4 is a timing chart showing how the controller 22 and pump driver 23 function and how the suction pump 16 is operated.

A waveform A shows timings at which the suction pump 16 is switched on and off. As shown by this timing waveform A, the suction pump 16 is kept on-state only for a time period T in which a time needed to develop the latent image on the recording medium and times needed before and after this image developing time are included.

A waveform B denotes signal outputted from the timer circuit in the controller 22. As shown by this waveform B, timer signal Sb is outputted to increase the pumping capacity of the pump 16 only for a time period starting from a time point t1 at which a command for starting the suction pump 16 or development is generated, and ending with a time point t2.

A waveform C shows the operation of the suction pump 16. As shown by this waveform C, the suction pump 16 is controlled to operate under high pumping capacity HP only for a time period equal to the time width of the timer signal Sb, and then under low pumping capacity LP.

When the pump driver 23 receives the timer signal Sb from the controller 22, it increases those parameters which change voltage supplied to the suction pump 16 or the pumping capacity of the pump 16 only for the time period equal to the time width of the timer signal Sb. As the result, the suction pump 16 is controlled to operate under the high pumping capacity HP only for the time period during which the timer signal Sb is kept on-state. After the timer signal Sb is made off at the time point t2, the pump 16 is controlled to operate under the low pumping capacity LP. The normal developing operation is sequence-controlled to start after the time point t2 at which the timer signal Sb is made off.

It is now assumed that the developing head 10 includes the rod-like body 11 having a length of about 1 meter and six developing grooves 12 each having a sectional area of 2 mm×2 mm. It is preferable in this case that the suction pump 16 which can correspond to the developing head 10 is of the vane type and has a displacement of about 4 liters per minute. When the pump 16 which has this capacity is used, however it needs about 3–5 seconds until its suction force created by negative pressure becomes sufficient to suck the developer after its pumping start Namely, when the suction pump 16 is made operative under the condition that the image-formed face of the recording medium P to which a certain tension is applied is pushed against the developing grooves 12 on the top of the developing head 10, about 3–5 seconds are needed until the suction force of the pump created by negative pressure becomes large enough to suck the developer after the pump is started. In order to more reliably contact the recording medium P with the top of the developing head 10, it is needed that the recording medium P adheres to it while being carried. When the recording medium P is unevenly slackened under high humidity or it is curled at its edge, it sometimes does not adhere to the developing head 10.

In order to solve these problems, the inventor of the present invention operated the suction pump 16 to have a displacement of 12 liters per minute by using the same developing head 10 and recording medium P and increasing the rotation number of the pump motor (not shown) three times the normal one of it. As the result, the recording medium P was stuck to the developing head 10 in 1.0—1.5 seconds even while it was being kept stationary. Even when it had some slackened portions and curls caused under high humidity, it was found that the probability of its failing in adhering to the top of the developing head 10 was extremely lowered.

When the suction pump 16 is continuously operated under the condition that its displacement is kept 12 liters per minute, however, the running load of the recording medium P is increased to a great extent. According to the fact recognized by the inventor, the running load of the recording medium P became about 2.5 times as compared with the case where the displacement of the pump was set 4 liters per minute. When plural-colored images are formed overlapping black, cyanogen, magenta and yellow images one upon the others under the condition that the running load is increased to this extent, many irregular dust lines and fine broken-line like stripes which correspond to the unevenness of the base sheet for the recording medium P appear on the white background of the images thus formed. As the result, these recorded images seem extremely humble.

According to the second embodiment of the developing device, however, it is arranged that the suction pump 16 is controlled to operate under high pumping capacity only for the certain time period just after the developing device is started and that it is thereafter controlled to operate under low pumping capacity. This enables the recording medium P to quickly and reliably adhere to the top of the developing head 10 prior to the start of development. In addition, the running load of the recording medium P and the quality deterioration of the recorded images can be prevented from becoming large and serious.

When the pump motor (not shown) depends highly on voltage, voltage change is the easiest to change the capacity of the suction pump 16. When the pump motor depends highly on frequency as seen in the case of the AC induction motor, it is preferable that a mechanical rotating transmission system is used to change its rotating transmission ratio. Further, it can be arranged that a second suction sub-pump is connected parallel to the first main suction pump 16 and that the displacement of the first suction pump 16 is changed by appropriately switching the second suction pump on and off. Still further, it may be arranged that the throttle valve located in the piping extending from the outlet 14 of the developing head 10 to the tank 15 via the suction pump 16 is adjusted to control the pumping capacity of the pump 16, as already described above relating to the first embodiment.

In the case of the first embodiment shown in FIG. 1, attention was paid to the fact that the recording media P of a kind have a specific value of surface roughness, and the pumping capacity of the pump was adjusted and controlled according to each kind of the recording media P. More remarkable effects can be thus achieved as compared with the case where no control is applied to the pumping capacity of the pump. In those cases where the recording media P can not be specified, the kind of the recording media P is likely to be mistakenly specified and the surface roughness of the recording media P belonging to a lot is different from that of them belonging to another lot, however, it cannot be sometimes expected that these remarkable effects are attained.

(Third Embodiment)

Figure 5:
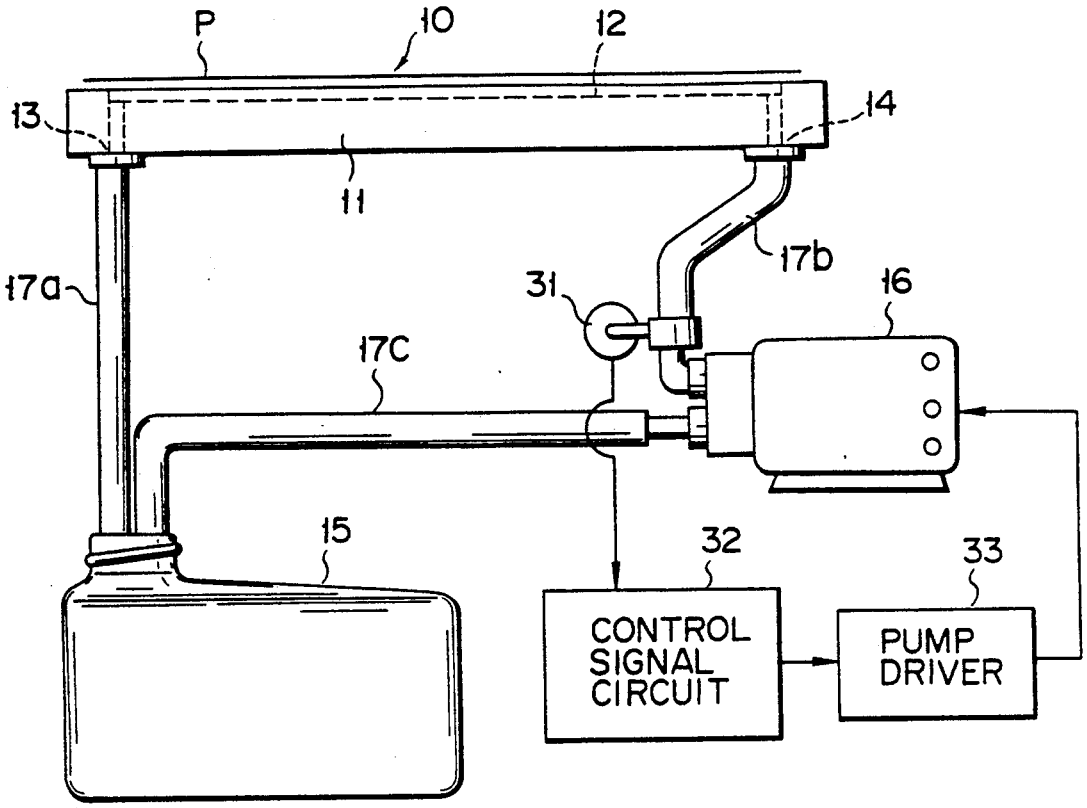
Figure 6:
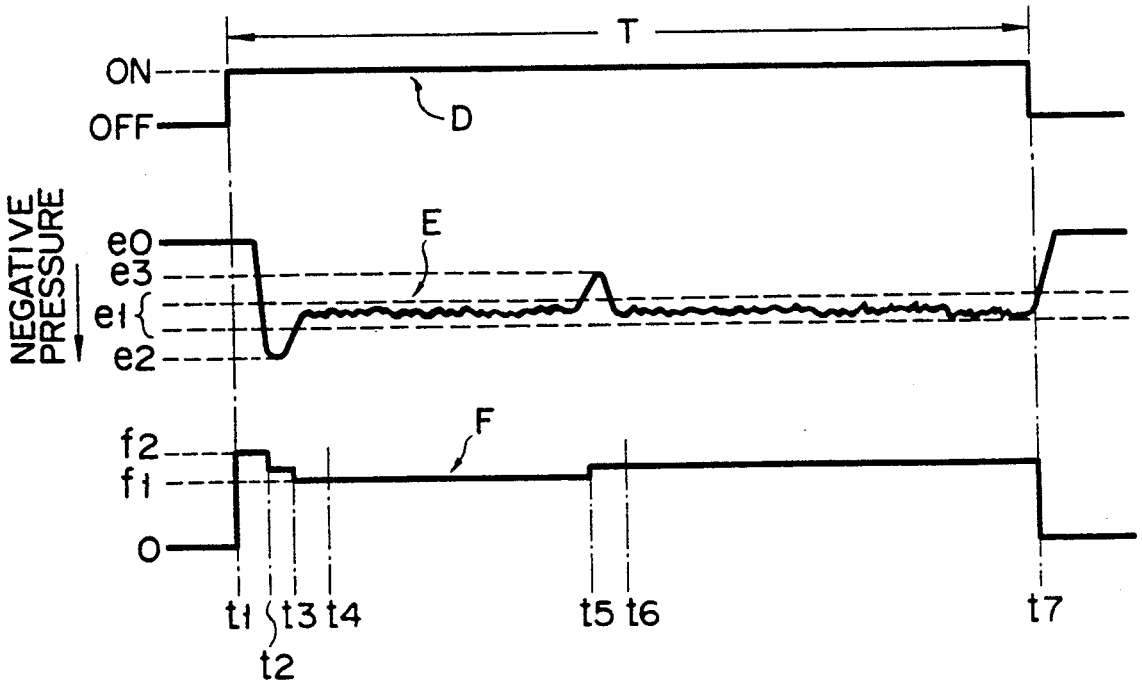

FIGS. 5 and 6 show a third embodiment of the developing device according to the present invention, which is so arranged as to eliminate the above-mentioned drawback.

In FIG. 5, reference numeral 31 denotes a negative pressure sensor, 32 a control signal circuit and 33 a pump driver. Other components are same as those of the first embodiment shown in FIG. 1.

The negative pressure sensor 31 may be arranged in the pipe 17*a* on the inlet side of the developing head 10 but it is useless if the negative pressure sensor 31 is located in the pipe 17*c* between the suction pump 16 and the tank 15. Detection signal which represents a negative pressure detected by the negative pressure sensor 31 is sent to the control signal circuit 32, where one of control signals representing that the level of this negative pressure is "low", "correct" or "high" is generated, depending upon whether or not the detection signal is in a previously set control range. This control signal is sent to the pump driver 33. The pump driver 33 comprises combining the power supply 18 and the control measures 19 shown in FIG. 1, for example, with each other as a unit. When the pump driver 33 receives the control signal from the control signal circuit 32, therefore, it controls the pumping capacity of the suction pump 16 responsive to the control signal received.

FIG. 6 shows timings at which the device shown in FIG. 5 is operated.

A waveform D shows a time period during which the suction pump 16 is kept operative. This time period T starts from a time point t1 and ends with a time point t7.

A waveform E shows the detection signal detected by the negative pressure sensor 31, in which e0 denotes a level of negative pressure, e1 a range of controlled level, e2 a large level of negative pressure and e3 a small level of negative pressure.

A waveform F shows how the pumping capacity of the pump controlled by the detection signal is changed, in which f1 represents an intermediate level and f2 a high level.

When the suction pump 16 is switched on at the time point t1, air is removed from the pipe 17*b* and the developing groove 12 and the recording medium P is stuck to the top of the developing head 10. The level of negative pressure in the pipe 17*b*, liquid developer flowing passages 12, pipe 17*a* and the like becomes large accordingly. The negative pressure sensor 31 detects the large negative pressure level e2 and the developer starts circulating through the circulating line of the device at the same time.

When the suction pump 16 is previously set to operate with high pumping capacity, the negative pressure level e2 higher than the controlled level e1 is detected at the time point t2. The signal representing that the pumping capacity of the pump is "high" is thus sent from the control signal circuit 32 to the pump driver 33, which responds to this signal to lower the pumping capacity of the pump 16 by one step at once. However, the pumping capacity of the pump is further lowered by another step, because the negative pressure level is still too high at the time point t3. As the result, the negative pressure level is included in the range of controlled level el at the time point t4. The signal denoting that the negative pressure level is "correct" is thus sent from the control signal circuit 32 to the pump driver 33 to keep the suction pump 16 operating under this state.

When the recording medium P is slackened to make the negative pressure level abnormal at the time point t5, the small negative pressure level e3 which is not included in the range of controlled level el is detected by the negative pressure sensor 31. The signal representing that the negative pressure level is "low" is thus sent from the control signal circuit 32 to the pump driver 33, which raises the pumping capacity of the pump by one step responsive to the signal applied. As the result, the negative pressure level is returned into the range of controlled level e1 at the time point t6 and the pump 16 is thereafter kept operating under this state. When the pump 16 is stopped at the time point t7, the detection of negative pressure by the negative pressure sensor 31 and the control of pumping capacity responsive to this detection of negative pressure are finished accordingly.

These changes of control are carried out every unit cycle to make the operation of the feedback loop normal. This enables a stable control to be attained while keeping it not overshot.

According to the above-described third embodiment, negative pressure in the liquid developer circulating line can be automatically detected by the negative pressure sensor 31 and controlled to keep the negative pressure level present in the predetermined range of controlled level e1. It is not needed therefore that kinds and conditions of the recording media P are specified. The amount of the liquid developer circulated and the running load of the recording medium p can be thus kept in their predetermined ranges. Further, the negative pressure sensor 31 detects atmospheric pressure at the start of development and the suction pump 16 therefore starts its operation with high pumping capacity. As the result, the recording medium P can be quickly and reliably stuck to the top of the developing head 10, as seen in the case of the second embodiment. The time needed to prepare development can be thus shortened. Even when the developing head of the roller type is used instead of the one in this embodiment, same effects can be expected.

(Fourth Embodiment)

Figure 7:
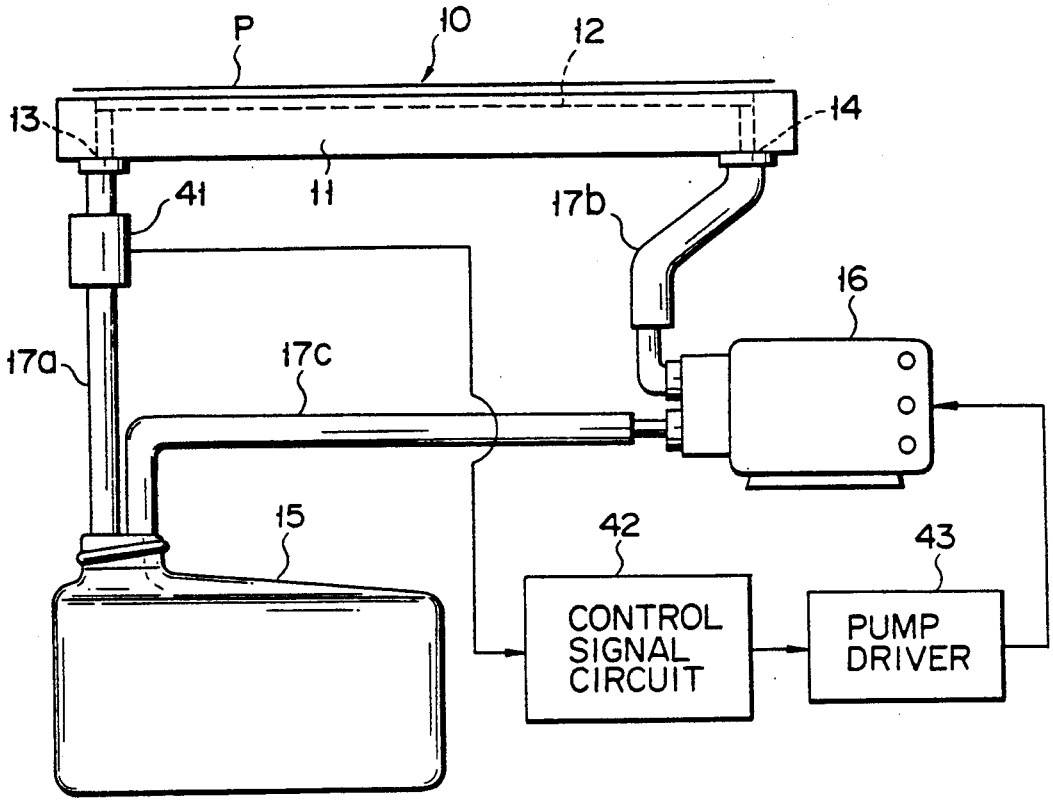
Figure 8:
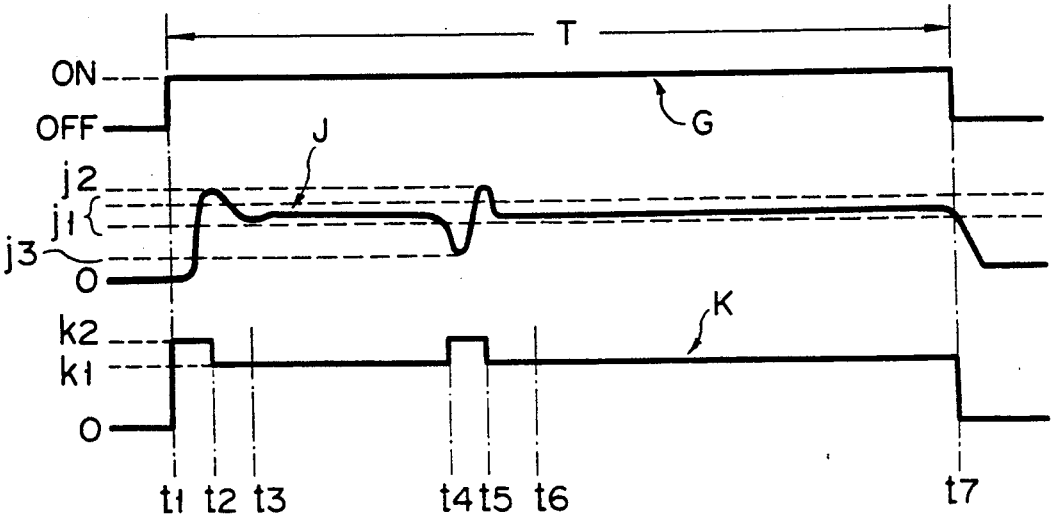

FIGS. 7 and 8 show a fourth embodiment of the developing device according to the present invention, which is so arranged as to control the pumping capacity of the suction pump 16 responsive to the flow rate of the liquid developer detected In FIG. 7, reference numeral 41 denotes an instantaneous flow rate sensor, 42 a control signal circuit and 43 a pump driver . Other components of this example are same as those in the first example shown in FIG. 1.

The instantaneous flow rate sensor 41 serves to create pulses whose cycle is inversely proportional to the flow rate of the developer, and various sensors of this type are well known. As shown in FIG. 7, it is preferable that the instantaneous flow rate sensor 41 is attached to the pipe 17*a* between the tank 15 and the developing head 10. This is because no air is contained in the liquid developer flowing the pipe 17*a* and because accurate measurement of the flow rate can be thus easily conducted. The flow rate detected by the instantaneous flow rate sensor 41 is sent to the control signal circuit 42, where it is compared with a previously set one and found to be "excessive", "correct" or "short". When it is "excessive" or "short", a command for changing the pumping capacity of the pump is sent to the pump driver 43.

FIG. 8 shows timings at which the device shown in FIG. 7 is controlled.

A waveform G shows a time period during which the suction pump 16 is kept operative and this time period T starts from a time point t1 and ends with a time point t7.

A waveform J shows detection signal applied from the instantaneous flow rate sensor 41, in which j1 denotes a range of controlled flow rate level, j2 excessive flow rate levels and j3 a short flow rate level.

A waveform K shows a change in the controlled pumping capacity of the pump, in which k1 represents an intermediate level and k2 a high level.

When the suction pump 16 is switched on at the time point t1 and the recording medium P seals the developing groove 12 on the top of the developing head 10, the liquid developer starts to circulate through the circulating line of the device. When the excessive flow rate level j2 is detected at the time point t2, signal for lowering the pumping capacity of the pump is sent from the control signal circuit 42 to lower the pumping capacity of the pump. When the flow rate level detected is included in the range of controlled flow rate level, the suction pump 16 is kept operating.

When air leakage is caused because of wrinkles of the recording medium P at the time point t4 to make the flow rate short and the short flow rate level j3 is detected by the instantaneous flow rate sensor 41, signal for raising the pumping capacity of the suction pump 16 is sent from the control signal circuit 42 to the pump driver 43. which responds to this signal to raise the pumping capacity of the suction pump 16. The recording medium P is thus strongly sucked to again seal the developing groove 12 on the top of the developing head 10. As the result, the excessive flow rate level j2 is detected at the time point t5. Signal for lowering the pumping capacity of the pump 16 is thus sent from the control signal circuit 42 to the pump driver 43, which responds to this signal to lower the pumping capacity of the pump 16. The flow rate of the developer can be therefore kept in the range of controlled flow rate level j1 at the time point t6. When the pump 16 is stopped at the time point t7, the operation of the control signal circuit 42 is finished.

According to the fourth embodiment of the developing device, the flow rate of the liquid developer circulated can be automatically held at the predetermined level so as to prevent the developing capacity of the device from being changed. If the flow rate of the liquid developer circulated is held correct, the running load of the recording medium P and the negative pressure in the device can be prevented from becoming excessive. This automatically prevents the quality of images recorded on the recording media from being deteriorated. In addition, the effect of shortening the time needed to prepare the start of development can be similarly attained as seen in the case of the third embodiment. Even when the developing head of the roller type is used instead of the one 10 of this embodiment, same effects as those attained by the third embodiment can be expected.

(Fifth Embodiment)

Figure 9:
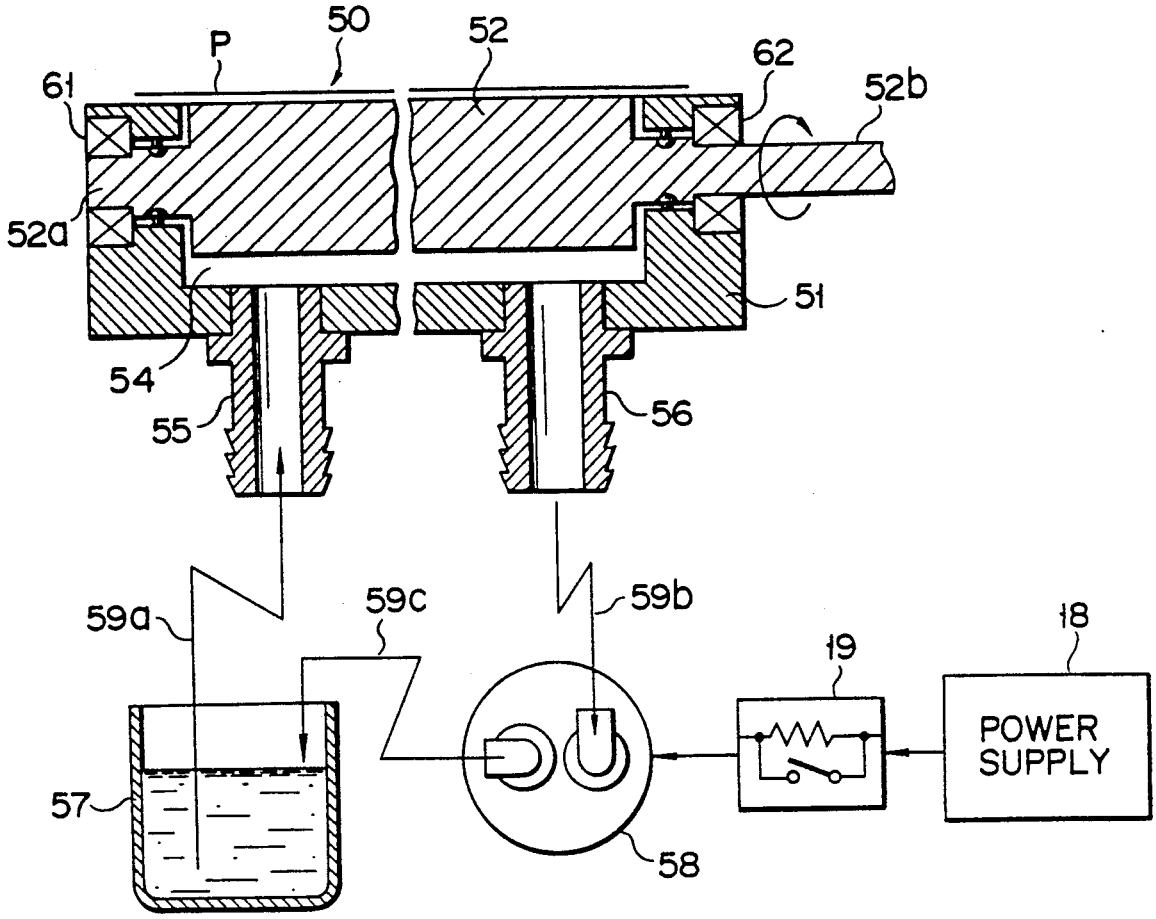
Figure 10:
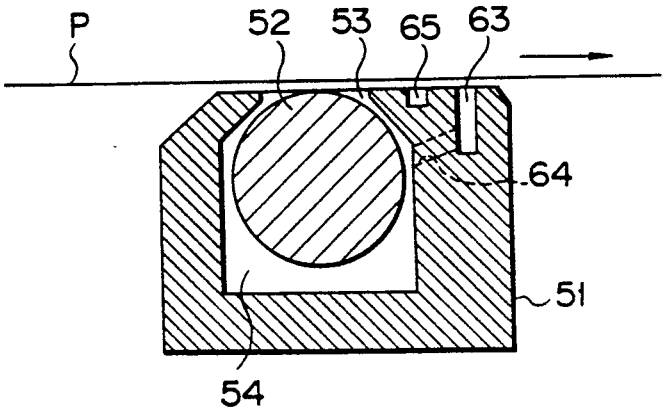

FIGS. 9 and 10 show a fifth embodiment of the developing device according to the present invention, in which a developing head 50 of the roller type is used and which is cited from the Japanese Patent Application Hei 01-264248. FIG. 9 is a front view showing the developing head 50 sectioned in the longitudinal direction thereof, together with related components connected thereto. FIG. 10 is a sectional view showing the center portion of the developing head 50 sectioned in a direction perpendicular to the longitudinal direction of the head 50.

As shown in FIGS. 9 and 10, the developing head 50 of the roller type is a box comprising a rod-like body 51 and a liquid chamber 54 formed in the rod-like body 51. This box is of air-tight type except those three portions such as a slit window 53 formed along the top of the liquid chamber 54 and serving as an opening through which the liquid developer acts on the recording medium P, an inlet 55 through which the liquid developer is supplied and an outlet 56 through which the liquid developer is discharged. A developing roller 52 driven and rotated by a drive source (not shown) is housed in the liquid chamber 54 of the box, with a part of its outer circumference located in the slit window 53. Reference numeral 57 represents a tank for storing the liquid developer, 58 a suction pump and 59*a*–59*c* pipes. Reference numerals 61 and 62 denote bearings for supporting shafts 52*a* and 52*b* extending from both end of the developing roller 52. Reference numeral 63 in FIG. 10 represents a slit-shaped groove formed on the top of the body 51 to suck, remove and dry the liquid developer excessively adhering to the recording medium P, but this slit-shaped groove 63 is not necessarily essential to the present invention. Numeral 64 denotes a hole for communicating the liquid chamber 54 with the groove 63 to apply negative pressure to the groove 63. Numeral 65 represents a separating groove for forming an atmospheric pressure area between the slit-shaped window 53 and the groove 63.

As seen in the case of the first embodiment, the pumping capacity of the suction pump 58 is controlled by the power supply 18 and control measures 19, depending upon the liquid developer circulated, for example.

When the recording medium P is moved while covering the slit-shaped window 53 and the suction pump 58 is made operative while keeping the developing roller 52 being rotated by the drive source, the recording medium P is closely sucked onto those portions of the top of the body 51 which define the slit-shaped window 53. Negative pressure is thus created in the liquid chamber 54 including the slit-shaped window 53. The liquid developer is introduced into the liquid chamber 54 through the inlet 55 by the action of the negative pressure. The liquid developer does not fill the liquid chamber 54, but it is introduced into the liquid chamber 54 to such an extent that the lower portion of the developing roller 52 can be immersed in it.

The liquid developer adheres to the surface of the developing roller 52 as the roller 52 rotates, and it as carried to the center of the slit-shaped window 53, through which it adheres to the recording medium P to develop an image on the medium P.

According to the developing device having the above-described arrangement, the liquid developer can be efficiently fed into the slit-shaped window 53, keeping the gap between the surface of the developing roller 52 and the recording medium P. This enables developing efficiency to be made high. In addition, another merit can be attained that the excessive liquid developer which adheres to the recording medium P passing on the slit-shaped window 53 in a direction shown by an arrow in FIG. 10 is sucked and removed by the negative pressure acting on the slit-shaped window 53. Further, the slit-shaped groove 63 serving to further suck and remove the liquid developer is additionally provided on the top of the rod-like body 51, so that the excessive liquid developer still left on the recording medium P can be substantially completely removed from the surface of the medium P. The possibility can be thus eliminated that solvent in the liquid developer is evaporated and diffused in the air.

The pumping capacity of the suction pump can also be controlled in this example according to surface roughnesses of the recording media P to hold the negative pressure correct, as seen in the case of the first embodiment. This enables various kinds of those drawbacks which could not be avoided in the conventional cases to be eliminated.

Although the pumping capacity of the suction pump 58 has been controlled on the basis of the previously-obtained information by the power source 18 and control means 19 in the case of this fifth embodiment, it may be arranged that the condition of the liquid developer circulated is detected by the negative pressure sensor or instantaneous flow rate sensor and that the pumping capacity of the suction pump 58 is controlled responsive to the information thus detected, as seen in the other above-described embodiment. Instead of detecting the negative pressure and the instantaneous flow rate, it may be arranged that the surface level of the liquid developer in the developing head 50 is detected to adjust and control the pumping capacity of the pump. More specifically, the surface level of the liquid developer in the developing head 50 is low when development is started. Further, it becomes lower as the recording medium P becomes higher in surface roughness. Still further, it becomes low when the liquid chamber 54 of the developing head 50 cannot be kept air-tight. To add more from the viewpoint of developing capacity, it does not add any influence to the developing capacity whether the surface level of the liquid developer in the liquid chamber 54 is a little high or low if the lower portion of the developing roller 52 is immersed in the liquid developer. When the surface level of the liquid developer in the developing head 50 is detected to adjust and control the pumping capacity of the suction pump 58, therefore, same effects as those achieved by the sensors shown in FIGS. 5 and 7 can be expected.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A developing device of the liquid developer type comprising:

a developing head including a rod-like body, at least one liquid developer flowing passage which is formed within the rod-like body for allowing a liquid developer to flow therethrough and which has a slit-shaped opening formed in the top of a rod-like body so as to cause the liquid developer to act on a latent image formed on a recording medium, and an inlet and an outlet provided in the lower portion of the rod-like body to communicate with both ends of the liquid developer flowing passage so as to allow the liquid developer to be introduced into the passage through the inlet and discharged out of the passage through the outlet;

a tank for storing the liquid developer, which has an inlet and an outlet connected to the inlet of the passage;

a suction pump provided with a suction inlet connected to the outlet of the passage and a discharge outlet connected to the inlet of the tank; and a means for adjusting and controlling the pumping capacity of the suction pump, responsive to a control command which represents a predetermined sequence and/or a state of the liquid developer circulated;

the passage, the tank and the suction pipe forming a liquid developer circulating line;

wherein when the suction pump is operated with a controlled pumping capacity while permitting the slit-shaped opening of the passage in the developing head to be covered by the recording medium, a predetermined negative pressure is created in the liquid developer circulating line, the liquid developer in the tank is introduced into the liquid developer circulating line by the action of the negative pressure to develop the latent image on the recording medium and then returned into the tank after this image development is finished.

2. The developing device of the liquid developer type according to claim 1, wherein the control command represents a surface roughness of the recording medium, and, further comprising a means for adjusting and controlling the pumping capacity of the suction pump, responsive to the control command.

3. The developing device of the liquid developer type according to claim 1, wherein said control means includes a timer circuit for controlling the suction pump to operate with high pumping capacity for a predetermined time period after the operation of the pump is started, and then with low pumping capacity.

4. The developing device of the liquid developer type according to claim 1, further comprising a sensor which detects the condition of the liquid developer flowing through the passage, and a means for adjusting and controlling the pumping capacity of the suction pump, responsive to a detection signal applied from the sensor.

5. The developing device of the liquid developer type according to claim 4, wherein said sensor is a negative pressure sensor for detecting negative pressure in the liquid developer circulating line.

6. The developing device of the liquid developer type according to claim 4, wherein said sensor is an instantaneous flow rate sensor for detecting a flow rate of the liquid developer circulated in the line.

7. The developing device of the liquid developer type according to claim 1, wherein said liquid developer flowing passage includes a plurality of slit-shaped developing grooves formed in the top of the rod-like body.

8. The developing device of the liquid developer type according to claim 1, wherein said liquid developer flowing passage comprises a liquid chamber formed in the center of the rod-like body, extended along the longitudinal axis thereof and opened to form a slit-shaped window on the top thereof and a developing roller housed in the liquid chamber and driven by a drive source, such that a part of its outer circumferential surface is disposed in the sit-shaped window substantially on the same plane as the top surface of the rod-like body.

* * * * *

UNITED STATES PATENT AND TRADEMARK OFFICE

CERTIFICATE OF CORRECTION

PATENT NO. : 5,016,036

DATED : May 14, 1991

INVENTOR(S) : M. NISHIKAWA

It is certified that error appears in the above-identified patent and that said Letters Patent is hereby corrected as shown below:

Title page, Section [56] References Cited, insert the following under "FOREIGN PATENT DOCUMENTS":

-- 52-25153 6/1977 Japan --.

Signed and Sealed this

Fourteenth Day of June, 1994

*Attest:*

Bruce Lehman

BRUCE LEHMAN

*Attesting Officer*

*Commissioner of Patents and Trademarks*